United States Patent [19]

Lyng

[11] Patent Number: 4,580,818

[45] Date of Patent: Apr. 8, 1986

[54] LOCKER LATCHING ASSEMBLY

[76] Inventor: William E. Lyng, Main St., Truthville, N.Y. 12854

[21] Appl. No.: 738,568

[22] Filed: May 28, 1985

Related U.S. Application Data

[63] Continuation-in-part of Ser. No. 664,615, Oct. 25, 1984, which is a continuation of Ser. No. 542,001, Oct. 14, 1983, abandoned.

[51] Int. Cl.[4] ..... E05C 1/04

[52] U.S. Cl. ..... 292/148; 292/DIG. 31; 292/DIG. 68

[58] Field of Search ..... 292/DIG. 31, DIG. 68, 292/148, DIG. 53, 137, 141, 145, 147, 152, 163, 175, 205, 104

[56] References Cited

U.S. PATENT DOCUMENTS

| | | | |
|---|---|---|---|
| 1,724,116 | 8/1929 | Swearengin . | |
| 2,912,271 | 11/1959 | Schaefer | 292/336.3 |
| 3,158,908 | 12/1964 | Springer | 20/16 |
| 3,572,062 | 3/1971 | Beebe | 292/340 |
| 3,866,961 | 2/1975 | List | 292/336.3 |
| 4,307,904 | 12/1981 | Daus | 292/148 |

FOREIGN PATENT DOCUMENTS

| | | | |
|---|---|---|---|
| 1463128 | 11/1966 | France | 292/148 |

*Primary Examiner*—Richard E. Moore

*Attorney, Agent, or Firm*—Heslin, Watts & Rothenberg

[57] ABSTRACT

A locker latching assembly having a recessed mounting receptacle with a horizontal double bolt mounted thereon for sliding reciprocal movement. The double bolt having a front bar and a back bar welded together at opposite ends. The front bar having the improvement comprising an outwardly extending, U-shaped protrusion located within the receptacle. The U-shaped protrusion providing several benefits including: limiting movement of the slide bolt past latched and unlatched positions, preventing an individual from jimmying a locked assembly, and serving as a means to pull the locker door open when the bolt is in an unlatched position.

10 Claims, 3 Drawing Figures

LOCKER LATCHING ASSEMBLY

CROSS-REFERENCE TO RELATED APPLICATIONS

This application is a continuation-in-part of copending application, Ser. No. 664,615, filed Oct. 25, 1984, which, in turn, is a continuation of my previous application, Ser. No. 542,001, filed on Oct. 14, 1983, now abandoned.

FIELD OF THE INVENTION

This invention relates to a locker latching assembly generally used in wardrobe-type lockers.

BACKGROUND OF THE INVENTION

Wardrobe lockers are installed in virtually every public and private school facility and in a variety of other locations, such as train stations, bus depots and airports. A preferred locking system, especially in school facilities, is one that incorporates the use of a padlock. Traditionally, the most commonly installed locking system has utilized a three-point gravity latch assembly. In this latching assembly, a long vertical internal latching member in the locker door is operated by lifting an external handle attached to the latching member. Upon release of the handle, the latching member gravitates to a latched position. Typically, the latching member will engage hook-shaped hardware mounted at three places in the door jam. The latching member is normally fabricated of thin molded metal which cannot withstand years of continued use, particularly in today's school systems.

Experience has indicated that this latching assembly is expensive to maintain and frequently requires repairs. Manufacturers of this system are constantly changing their designs in an attempt to improve the performance of the latching mechanism and to decrease the cost of repair and maintenance. Consequently, replacement parts are no longer available for some of the older models, and some schools are faced with replacement of the entire latching assembly. In spite of determined efforts by locksmiths and locker manufacturers to provide a better assembly, the three-point gravity latch remains the currently available standard.

In addition to maintenance and repair difficulties, a locking system based upon the three-point gravity latch does not provide adequate safeguards against vandalism. The adept and determined student can, without much difficulty, gain access to any locker by using a simple jimmying process.

SUMMARY OF THE INVENTION

I have discovered that the shortcomings of the prior art can be overcome by designing a new locker latching assembly. I have found that, if the three-point gravity latch assembly is replaced by a one-point slide bolt assembly, the frequency of required maintenance and repair, and the cost associated therewith, can be reduced significantly. Furthermore, the simplicity of my design, accompanied by the use of heavy-duty materials provides a system that offers increased protection against vandalism. My invention is economical to produce and can be used in both new products and in repair programs to replace more traditional latching assemblies. My new latching assembly requires no modification of design nor special construction of associated locker doors and frames. Installation is easily accomplished by cutting an appropriately sized opening in the locker door. Once installed, the overall appearance of the locker door is improved because the recessed latching assembly creates a smooth, flush front for the locker door.

More specifically, the basic locker latching assembly as disclosed in my previous applications includes a recessed mounting receptacle and a double slide bolt. The recessed mounting receptacle is generally of a square or rectangular shape which can be set into a locker door. The double slide bolt is comprised of a front bar and a back bar welded together at opposite ends and spaced apart such that the front bar passes through longitudinal slots on opposite side walls of the receptacle, in front of the back wall of the receptacle, and the back bar passes behind the back wall of the receptacle. The slide bolt is designed to move freely back and forth. The length of the slide bolt is such that a pre-determined portion of the slide bolt will extend beyond the receptacle and behind the locker door jam when the slide bolt is located in a latched position.

In the preferred embodiment of my present invention, the front bar of the slide bolt has an outwardly extending, substantially U-shaped protrusion located within the receptacle. A first lock receiving aperture extends through the U-shaped protrusion. The first lock receiving aperture is aligned with a second lock receiving aperture which extends through a member attached to the receptacle and depending within the U-shaped protrusion of the front bar. The latching assembly may be locked in a latched position by the insertion of a padlock through these aligned apertures. The U-shaped protrusion on the front bar provides several advances over the structure disclosed in my previous applications including: limiting movement of the slide bolt past latched and unlatched positions, effectively preventing an individual from jimmying the locked assembly, and serving as a means to guide the slide bolt between latched and unlatched positions and as a means to pull the locker door open when the slide bolt is in an unlatched position.

One of the major objects of this invention is to provide a locker latching assembly having a single point latch which is inexpensive to maintain and has a low frequency of required repairs.

Another object of the present invention is to provide a heavy-duty latching assembly which when locked will effectively deter vandalism.

Yet another object of the present invention is to provide a latching assembly capable of use in replacing worn out or damaged three-point gravity latch assemblies without having to replace the entire locker.

It is a further object of this invention to provide a latching assembly and locking system which is completely recessed in order to give a modern, flushed-front appearance to old lockers.

It is a still further object of this invention to provide a new latching assembly that can overcome the difficulties of prior latching systems and also be economical to produce.

BRIEF DESCRIPTION OF THE DRAWINGS

For a more complete understanding of the present invention and the advantages thereof, reference is now made to the following description, taken in conjunction with the accompanying drawings in which.

DETAILED DESCRIPTION OF THE INVENTION

Figure 1:
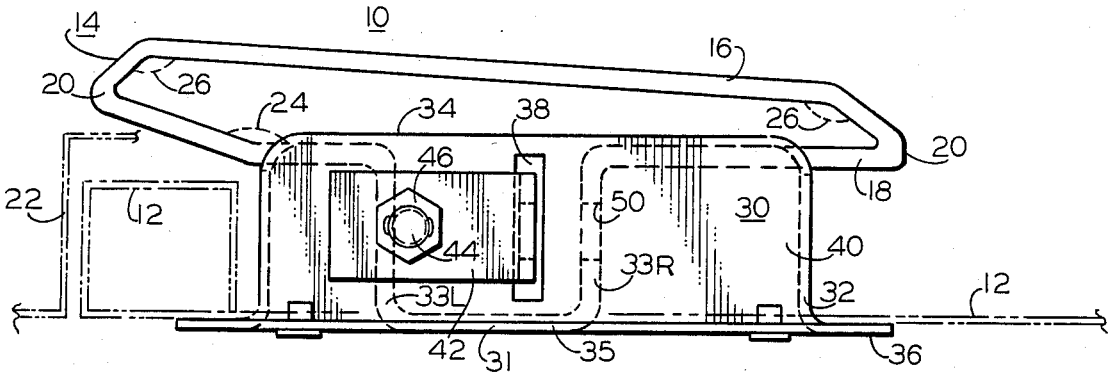
FIG. 1 is a top plan view of the recessed locker latching assembly of the present invention mounted in a locker door.

Referring to FIG. 1, the locker latching assembly 10 of the present invention is shown mounted in locker door 12 (shown in phantom) which opens from the left. Locker door 12 is in its closed position and slide bolt 14 is shown approximately half way between its latched and unlatched positions. FIG. 1 shows the double bar construction of slide bolt 14 which contributes significantly to the overall strength of this latching assembly. Slide bolt 14 consists of two rectangular bars, front bar 18 and back bar 16, welded together at opposite ends 20. The length of slide bolt 14 is variable depending upon the particular locker unit for which the latching assembly is constructed. It is important that slide bolt 14 be capable of extending a sufficient distance behind locker frame 22. As shown in FIG. 1, front bar 18 and back bar 16 are preferably asymmetric and the distance between front bar 18 and back bar 16 is variable. This distance is varied as needed to correspond to the particular locker unit for which the latching assembly is designed. Also, front bar angle 24 and back bar angles 26 may be varied depending upon the thickness of locker door frame 22. Front bar angle 24 and back bar angles 26 must at all times be sufficient to permit slide bolt 14 to move freely in a reciprocal fashion between a latched and an unlatched position. Slide bolt 14 is preferably made of heavy duty rolled steel and coated with corrosion resistant nickel.

Figure 2:
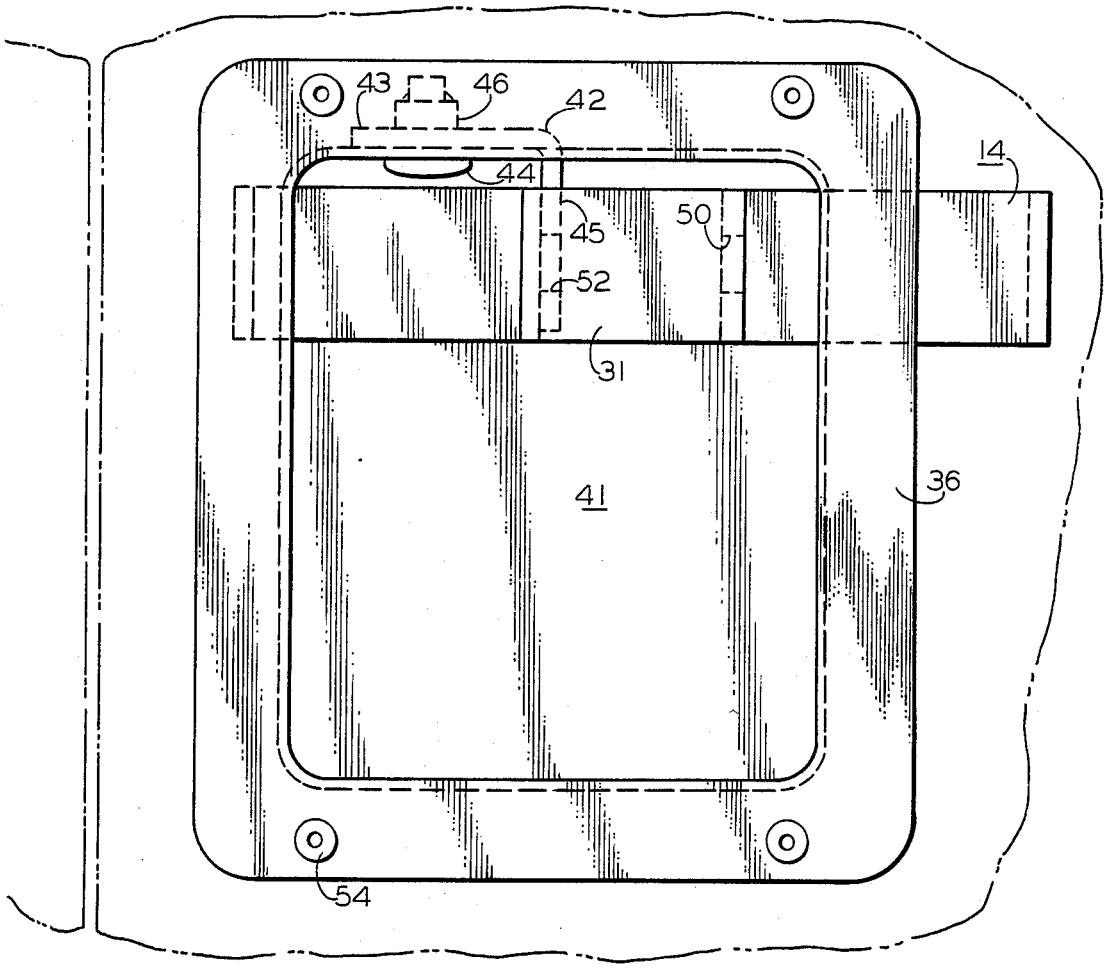
FIG. 2 is a front elevational view of the locker latching assembly of the present invention, showing the assembly in its unlatched position and the locker door closed.

Still referring to FIG. 1, an outwardly extending, U-shaped protrusion 31 on front bar 18 is shown. The U-shaped protrusion 31 is located within the receptacle 30. The U-shaped protrusion 31 includes a right side wall 33R, a left side wall 33L, and a front connecting member 35. A first lock receiving aperture 50 is shown extending through side wall 33R. The U-shaped protrusion 31 is dimensioned so as to limit the movement of slide bolt 14 as shown in FIG. 2. This limiting function is sufficient to prevent welded ends 20 of slide bolt 14 from striking the receptacle 30, thus avoiding any damage that would result from such striking. The U-shaped protrusion 31 also functions as a means to guide the slide bolt 14 between its latched and unlatched positions and as a means to pull the locker door open when the latching assembly is in its unlatched position.

As best shown in FIG. 1, receptacle 30 is recessed to a depth that will fit into most standard lockers. Receptacle 30 is molded using one continuous sheet of drawn metal, preferably 18 gauge, so as to form outwardly extending side walls 32, rear wall 34, and open front portion 41 (shown in FIG. 2), and a flange 36 extending from the side walls 32 at the open front portion 41. Longitudinal slots 37 are cut into each of two opposite side walls 32 of receptacle 30 sufficient to allow the slide bolt 14 to be moved in a reciprocal fashion between a latched and an unlatched position.

A laterally inwardly extending slot 38 is cut into a top side wall 40 in order to accommodate an L-shaped member 42, as best shown in FIG. 2. L-shaped member 42 has a first arm 43 extending across the top side wall 40 and a second arm 45 extending downward through the laterally inwardly extending slot 38. L-shaped member 42 is preferably mounted to receptacle 30 by inserting bolt 44 up through a predrilled hole in the receptacle 30 and in the first arm 43, and by fastening bolt 44 with nut 46. A spanner bolt with a tapered shank has proven most useful for this attachment, but those skilled in the art will understand that other types of bolts may be used. In FIG. 2 it can be seen that the second arm 45 of L-shaped member 42 depends downward within the U-shaped protrusion 31. A second lock receiving aperture 52 is shown extending through the second arm 45. The first and second lock receiving apertures are aligned so as to accommodate a padlock. Lastly, receptacle 30 is secured to locker door 12 by rivets 54 through a plurality of openings drilled into flange 36.

Figure 3:
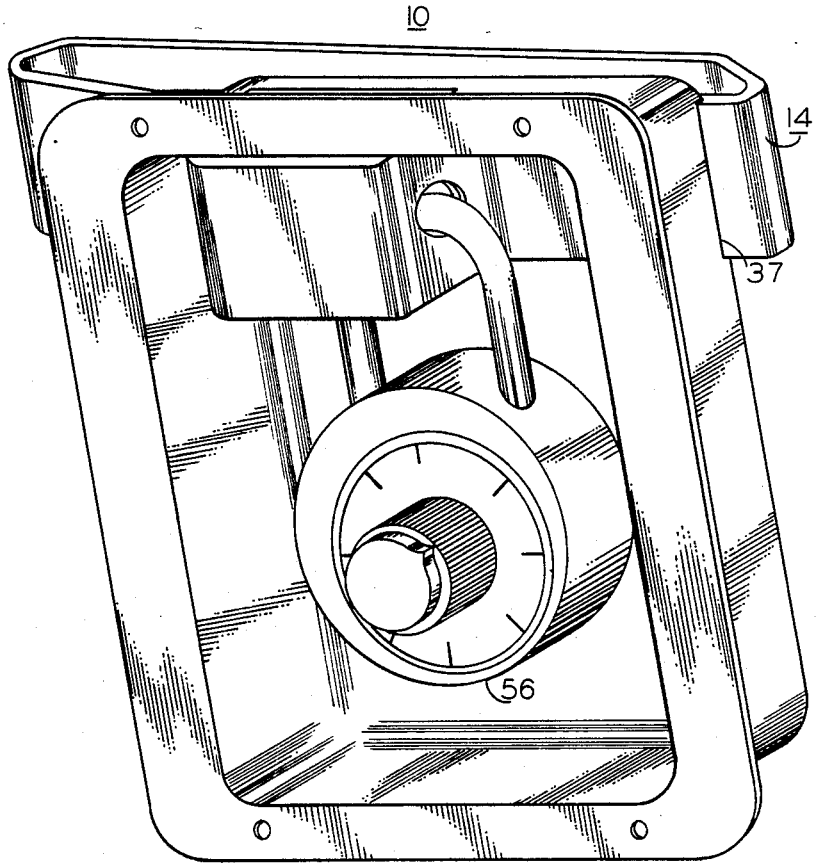
FIG. 3 is a perspective view from the right front side of the latching assembly, showing the assembly in its latched position and locked.

With reference to FIG. 3, the latching assembly of the present invention is shown locked in a latched position by padlock 56. It can be appreciated from this figure that the U-shaped protrusion 31 can effectively limit an individual's ability to manipulate padlock 56, and in so doing provide greater security against vandalism. It can also be appreciated from FIG. 3 that there are no edges exposed upon which an individual could be injured. Also, it can be observed that the U-shaped protrusion 31 provides several improvements over the structure disclosed in my continuation application, for example, greater resistance to jimmying, substantially the same size lock receiving apertures allowing for easier padlock insertion and removal, and means for limiting movement of the slide bolt 14. Finally, the flush, streamlined appearance of latching assembly 10 is evident. There are no protruding parts and even padlock 56 is recessed within receptacle 30.

Although one embodiment of the invention has been illustrated in the accompanying drawings and described in the foregoing detailed description, it will be understood that the invention is not limited to the embodiment disclosed, but is capable of rearrangements, modifications and substitutions without departing from the scope of the invention. For example, the U-shaped protrusion in the front bar may be constructed as a separate element welded onto the front bar. Other changes within the scope of the invention as defined by the appended claims, will suggest themselves to those versed in this art.

What I claim is:

1. A locker latching assembly comprising:

a recessed mounting receptacle having a rear wall, outwardly extending side walls, an open front portion, and a flange extending from said side walls at the open front portion;

two longitudinally extending slots, one each located along each of two opposite side walls of the receptacle;

a slide bolt horizontally reciprocally operable between a latched and an unlatched position such that a predetermined portion of the slide bolt may move in a reciprocal fashion behind a locker door frame, said slide bolt having front and back bars held together at opposite ends and in a spaced-apart relationship such that the front bar passes through the longitudinally extending slots in front of the rear wall and the back bar passes behind the rear wall, the front bar having an outwardly extending, substantially U-shaped protrusion located within the receptacle, the substantially U-shaped protrusion having a first lock receiving aperture; and a depending member affixed to the receptacle and depending within the substantially U-shaped protrusion of the front bar, said depending member having a second lock receiving aperture in substantial alignment with the first lock receiving aperture so that a padlock may be inserted through the first and second lock receiving apertures to lock said slide bolt in a latched position.

2. A locker latching assembly as in claim 1, wherein the substantially U-shaped protrusion is integral with the front bar.

3. A locker latching assembly as in claim 2, further comprising a laterally inwardly extending slot located along a top side wall of the receptacle, and wherein the depending member affixed to the receptacle comprises:

an L-shaped member, said L-shaped member having a first arm extending across the top side wall of the receptacle and a second arm extending downward through the laterally inwardly extending slot, said second arm having the second lock receiving aperture; and means for securing the L-shaped member to the receptacle.

4. A locker latching assembly as in claim 3, further comprising:

means cooperating with said flange for attaching the receptacle to a locker door.

5. A locker latching assembly as in claim 4, wherein the flange is provided with a plurality of holes therethrough and wherein the means for attaching the receptacle to the locker door comprises securing means extending through said flange holes.

6. A locker latching assembly comprising:

a recessed mounting receptacle having a rear wall, outwardly extending side walls, an open front portion, and a flange extending from said side walls at the open front portion;

two longitudinally extending slots, one each located along each of two opposite side walls of the receptacle;

a slide bolt having front and back bars held together at opposite ends and in a spaced-apart relationship such that the front bar passes through the longitudinally extending slots in front of the rear wall and the back bar passes behind the rear wall, the slide bolt being horizontally reciprocally operable between a latched and an unlatched position such that a predetermined portion of the slide bolt may move in a reciprocal fashion behind a locker door frame;

an outwardly extending, substantially U-shaped handle located within the receptacle, said substantially U-shaped handle being attached to the front bar and having two outwardly extending side members and a front member connecting said outwardly extending side members, one of said side members having a first lock receiving aperture;

a depending member affixed to the receptacle and depending within the substantially U-shaped handle, said depending member having a second lock receiving aperture in substantial alignment with the first lock receiving aperture so that a padlock may be inserted through the first and second lock receiving apertures to lock said slide bolt in its latched position.

7. A locker latching assembly as in claim 6, further comprising a laterally inwardly extending slot located along a top side wall of the receptacle, and wherein the depending member affixed to the receptacle comprises:

an L-shaped member, said L-shaped member having a first arm extending across the top side wall of the receptacle and a second arm extending downward through the laterally inwardly extending slot, said second arm having the second lock receiving aperture; and means for securing the L-shaped member to the receptacle.

8. A locker latching assembly as in claim 7, further comprising:

means cooperating with said flange for attaching the receptacle to a locker door.

9. A locker latching assembly as in claim 8, wherein the flange is provided with a plurality of holes therethrough and wherein the means for attaching the receptacle to the locker door comprises securing means extending through said flange holes.

10. A locker latching assembly as in claim 9, wherein the slide bolt and U-shaped handle are comprised of heavy duty rolled steel coated with corrosion resistant nickel.

* * * * *